US011754314B2

(12) United States Patent
Yu et al.

(10) Patent No.: US 11,754,314 B2
(45) Date of Patent: Sep. 12, 2023

(54) WATER RECEIVING TRAY AND CHASSIS ASSEMBLY FOR WINDOW AIR CONDITIONER, AND WINDOW AIR CONDITIONER

(71) Applicants: GD MIDEA AIR-CONDITIONING EQUIPMENT CO., LTD., Foshan (CN); MIDEA GROUP CO., LTD., Foshan (CN)

(72) Inventors: Hui Yu, Foshan (CN); Zhigang Xing, Foshan (CN); Kangwen Zhang, Foshan (CN); Ali Zhao, Foshan (CN); Yu Liu, Foshan (CN); Wenjun Shen, Foshan (CN); Yuhang Tang, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 283 days.

(21) Appl. No.: 16/914,987

(22) Filed: Jun. 29, 2020

(65) Prior Publication Data

US 2021/0199337 A1 Jul. 1, 2021

Related U.S. Application Data

(63) Continuation of application No. PCT/CN2020/077593, filed on Mar. 3, 2020.

(30) Foreign Application Priority Data

Dec. 31, 2019 (CN) ..... 201911417697.1
Dec. 31, 2019 (CN) ..... 201922501791.7

(51) Int. Cl.
*F24F 13/22* (2006.01)
*F24F 11/88* (2018.01)
(Continued)

(52) U.S. Cl.
CPC ..... *F24F 13/224* (2013.01); *F24F 1/027* (2013.01); *F24F 1/031* (2019.02); *F24F 11/88* (2018.01); *F24F 13/20* (2013.01); *F24F 2221/20* (2013.01)

(58) Field of Classification Search
CPC ..... F24F 13/224; F24F 1/027; F24F 1/031; F24F 11/88; F24F 13/20; F24F 2221/20
See application file for complete search history.

(56) References Cited

U.S. PATENT DOCUMENTS 6,381,978 B1 * 5/2002 Moretti et al. ..... F25B 29/00 62/262
6,389,834 B1 * 5/2002 LeClear et al. ..... F25B 47/00 62/280
(Continued)

FOREIGN PATENT DOCUMENTS

CN 101871678 A 10/2010
CN 203605428 U * 5/2014 ..... F24F 13/22
(Continued)

OTHER PUBLICATIONS

CN109959079A Translation (Year: 2019).*
(Continued)

*Primary Examiner* — Elizabeth J Martin
*Assistant Examiner* — Dario Antonio Deleon
(74) *Attorney, Agent, or Firm* — ANOVA LAW GROUP PLLC

(57) ABSTRACT

A water receiving tray for a window air conditioner includes a tray body and a wiring body. The tray body includes a water tank. The wiring body is provided at a side of the tray body proximal to an outdoor part of the window air conditioner. The wiring body includes a wiring groove.

18 Claims, 7 Drawing Sheets

(51) Int. Cl.

| | |
|---|---|
| ***F24F 1/031*** | (2019.01) |
| ***F24F 1/027*** | (2019.01) |
| ***F24F 13/20*** | (2006.01) |

(56) References Cited

U.S. PATENT DOCUMENTS

| | | | | |
|---|---|---|---|---|
| 6,868,689 | B1 * | 3/2005 | McNeil et al. | F24F 13/222 62/285 |
| 2003/0042010 | A1 * | 3/2003 | Kobayashi et al. | F24H 3/06 165/122 |

FOREIGN PATENT DOCUMENTS

| | | | | | |
|---|---|---|---|---|---|
| CN | 203605428 | U | | 5/2014 | |
| CN | 109959079 | A | * | 7/2019 | F24F 1/031 |
| CN | 109959079 | A | | 7/2019 | |
| CN | 209857232 | U | | 12/2019 | |
| KR | 100804614 | B1 | | 2/2008 | |

OTHER PUBLICATIONS

CN203605428U Translation (Year: 2014).*
World Intellectual Property Organization (WIPO) International Search Report and Written Opinion for PCT/CN2020/077593 with translation dated Aug. 27, 2020 16 Pages.
Canadian Intellectual Property Office The Office Action for CA Application No. 3085238 dated Jul. 29, 2021 5 Pages.

* cited by examiner

A-A

WATER RECEIVING TRAY AND CHASSIS ASSEMBLY FOR WINDOW AIR CONDITIONER, AND WINDOW AIR CONDITIONER

CROSS-REFERENCE TO RELATED APPLICATIONS

This application is a continuation of International Application No. PCT/CN2020/077593, filed on Mar. 3, 2020, which claims priority to Chinese Patent Application Nos. 201911417697.1 and 201922501791.7, both filed on Dec. 31, 2019, the entire contents of all of which are incorporated herein by reference.

FIELD

This application relates to a technical field of air processing devices, and particularly to a water receiving tray and a chassis assembly for a window air conditioner, and a window air conditioner.

BACKGROUND

In the related art, a water receiving tray for a window air conditioner has a single function, i.e., a function of receiving water, and cannot meet a layout requirement for internal components of the window air conditioner.

SUMMARY

The present disclosure seeks to solve at least one of the problems existing in the related art to at least some extent. To this end, the present disclosure provides a water receiving tray for a window air conditioner. The water receiving tray may make the internal wiring of the window air conditioner neater and simplify the structure and assembling process of the window air conditioner.

The present disclosure also provides a chassis assembly for a window air conditioner. The chassis assembly includes the above water receiving tray.

The present disclosure also provides a window air conditioner that includes the above chassis assembly.

The water receiving tray according to embodiments of the present disclosure includes: a tray body having a water tank; and a wiring body provided at a side of the tray body proximal to an outdoor part of the window air conditioner, and provided with a wiring groove.

For the water receiving tray of the window air conditioner according to the present disclosure, with the wiring body provided at the side of the tray body proximal to the outdoor part of the window air conditioner and the wiring body including the wiring groove, the wires inside the window air conditioner may be arranged in the wiring groove, such that the wiring inside the window air conditioner may become neater, and separate wiring structures may be avoided inside the window air conditioner, which may simplify the structure and assembling process of the window air conditioner, and improve the production efficiency.

According to some embodiments of the present disclosure, the wiring body and the tray body are detachably connected or are integrally formed.

According to some embodiments of the present disclosure, the wiring groove includes a power cord groove, a high-voltage wire groove, and a low-voltage wire groove; the power cord groove is disposed at one side of the wiring body, while the high-voltage wire groove and the low-voltage wire groove are disposed at the other side of the wiring body; the wiring body has a wire outlet at an end of the wiring body distal from the tray body; the power cord groove, the high-voltage wire groove, and the low-voltage wire groove are all in communication with the wire outlet.

According to some embodiments of the present disclosure, the high-voltage wire groove and the low-voltage wire groove are spaced apart from each other in a direction from the wiring body to the tray body.

According to some embodiments of the present disclosure, the power cord groove extends along an arc line.

According to some embodiments of the present disclosure, the high-voltage wire groove and the low-voltage wire groove extend along straight lines and extend in a direction perpendicular to a direction from the wiring body to the tray body; respective ends, proximal to the wire outlet, of side walls of the high-voltage wire groove and the low-voltage wire groove distal from the tray body are curved surfaces.

According to some embodiments of the present disclosure, a water leakage hole is provided at a bottom wall of the wiring groove.

According to some embodiments of the present disclosure, a bottom wall of the water tank includes a first wall surface and a second wall surface; the first wall surface is located at a side of the second wall surface proximal to the wiring body; in a direction from the first wall surface to the second wall surface, the first wall surface is inclined downward, and the second wall surface is inclined upward.

According to some embodiments of the present disclosure, a side of the tray body proximal to the wiring body is provided with a fluid guiding member and a fluid collecting member; the fluid guiding member and the fluid collecting member have a fluid guiding groove and a water collecting groove respectively in communication with the water thank; the wiring body is located between the fluid guiding groove and the water collecting groove.

According to some embodiments of the present disclosure, the first wall surface is inclined downward in a direction from the water collecting groove to the fluid guiding groove.

According to some embodiments of the present disclosure, a reinforcement rib is provided under the tray body.

The chassis assembly according to embodiments of the present disclosure includes: a chassis including an indoor part and an outdoor part; and the above water receiving tray, in which the tray body is located at the indoor part.

For the chassis assembly of the window air conditioner according to the present disclosure, with the wiring body provided at the side of the tray body proximal to the outdoor part of the window air conditioner and the wiring body including the wiring groove, the wires inside the window air conditioner may be arranged in the wiring groove, such that the wiring inside the window air conditioner may become neater, and separate wiring structures may be avoided inside the window air conditioner, which may simplify the structure and assembling process of the window air conditioner, and improve the production efficiency.

In some embodiments of the present disclosure, the water receiving tray and the chassis are connected by fasteners and/or through snap connection.

In some embodiments of the present disclosure, a wire clasp is provided at an end of the tray body, and the wire clasp is spaced apart from a side wall of the chassis to form a wiring space.

In some embodiments of the present disclosure, the wiring groove includes a power cord groove, the power cord groove is provided at a side of the wiring body, and the wire clasp is located at an end of the tray body proximal to the power cord groove.

In some embodiments of the present disclosure, an end of an outer peripheral wall of the tray body distal from the outdoor part and proximal to the wire clasp is provided with a first notch through which the power cord passes; an outer peripheral wall of the chassis is provided with a second notch through which the power cord passes; the second notch is corresponding to the first notch.

In some embodiments of the present disclosure, the outdoor part has a mounting groove for mounting a supercooling tube; a side of the tray body proximal to the wiring body is provided with a fluid guiding member, and the fluid guiding member has a fluid guiding groove in communication with the water thank; the fluid guiding groove is located at one end of the tray body; and an end of the fluid guiding groove extends toward the mounting groove and is in communication with the mounting groove.

In some embodiments of the present disclosure, the outdoor part is provided with a guide groove; an end of the fluid guiding groove distal from the tray body is in communication with one end of the guide groove, and the other end of the guide groove is in communication with the mounting groove.

In some embodiments of the present disclosure, the outdoor part has a drain hole; the side of the tray body proximal to the wiring body is provided with a fluid collecting member; the fluid collecting member has a water collecting groove in communication with the water tank; the water collecting groove is located at the other end of the tray body; and an end of the water collecting groove extends toward the outdoor part and is in communication with the drain hole.

In some embodiments of the present disclosure, a bottom wall of the indoor part is provided with an air inlet hole, and the tray body is provided with an avoidance hole corresponding to the air inlet hole.

The window air conditioner according to embodiments of the present disclosure includes the above chassis assembly.

For the window air conditioner according to the present disclosure, with the wiring body provided at the side of the tray body proximal to the outdoor part of the window air conditioner and the wiring body including the wiring groove, the wires inside the window air conditioner may be arranged in the wiring groove, such that the wiring inside the window air conditioner may become neater, and separate wiring structures may be avoided inside the window air conditioner, which may simplify the structure and assembling process of the window air conditioner, and improve the production efficiency.

In some embodiments of the present disclosure, a bottom wall of the water tank includes a first wall surface and a second wall surface; the first wall surface is located at a side of the second wall surface proximal to the wiring body; in a direction from the first wall surface to the second wall surface, the first wall surface is inclined downward, and the second wall surface is inclined upward; a lower end of an indoor heat exchanger of the window air conditioner abuts against the first wall surface.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

The above and/or additional aspects and advantages of the present disclosure will become apparent and more readily appreciated from the following descriptions made with reference to the drawings, in which.

Figure 1:
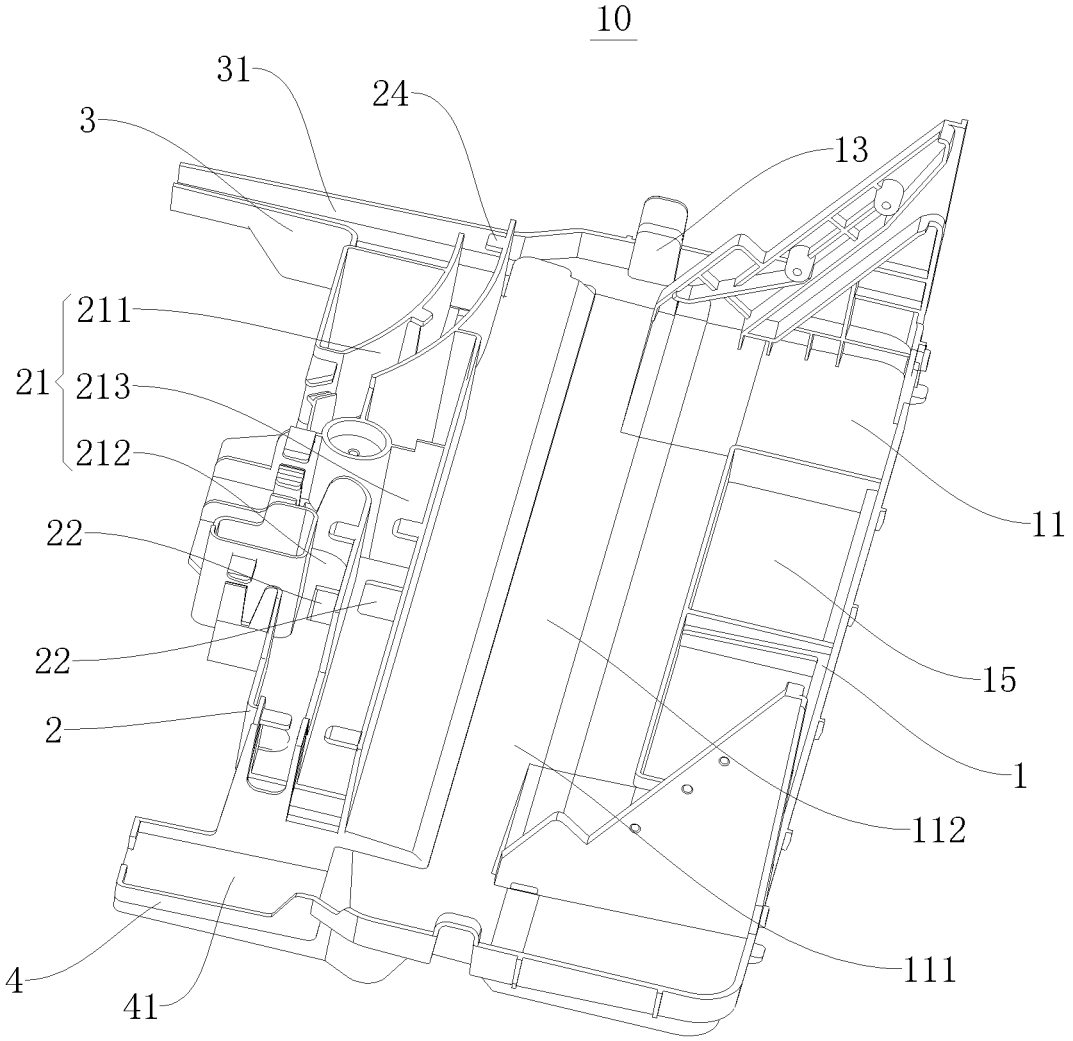
FIG. 1 is a perspective view of a water receiving tray for a window air conditioner according to an embodiment of the present disclosure.

REFERENCE NUMERALS window air conditioner 1000,
chassis assembly 100,
water receiving tray 10,
tray body 1, water tank 11, first wall surface 111, second wall surface 112, reinforcement rib 12, wire clasp 13, first notch 14, avoidance hole 15,
wiring body 2, wiring groove 21, power cord groove 211, high-voltage wire groove 212, low-voltage wire groove 213, water leakage hole 22,
fluid guiding member 3, fluid guiding groove 31,
fluid collecting member 4, water collecting groove 41,
chassis 20, indoor part 201, outdoor part 202, second notch 203, mounting groove 204, drain hole 205, air inlet hole 206, guide groove 207,
indoor heat exchanger 200.

DETAILED DESCRIPTION

Reference will be made in detail to embodiments of the present disclosure, and the examples of the embodiments are illustrated in the drawings, wherein the same or similar elements and the elements having same or similar functions are denoted by like reference numerals throughout the descriptions. The embodiments described herein with reference to drawings are illustrative, and merely used to explain the present disclosure. The embodiments shall not be construed to limit the present disclosure.

In the present disclosure, it shall be understood that terms such as "length," "width," "upper," "lower," "bottom," "inner," "outer," "circumferential" and the like should be construed to refer to the orientation or position as then described or as shown in the drawings under discussion. These relative terms are for convenience and simplification of description and do not indicate or imply that the device or element referred to must have a particular orientation, or be constructed or operated in a particular orientation, and thus shall not be construed to limit the present disclosure. In addition, the feature associated with "first" and "second" may comprise one or more of this feature. In the description of the present disclosure, the term "a plurality of" means two or more than two, unless specified otherwise.

In the present disclosure, unless specified or limited otherwise, the terms "mounted," "connected," "coupled" and the like are used broadly, and may be, for example, fixed connections, detachable connections, or integral connections; may also be mechanical or electrical connections; may also be direct connections or indirect connections via intervening structures; may also be inner communications of two elements, which could be understood by those skilled in the art according to specific situations.

A water receiving tray 10 for a window air conditioner 1000 according to embodiments of the present disclosure will be described below with reference to the drawings.

As shown in FIG. 1, the water receiving tray 10 for the window air conditioner 1000 according to an embodiment of the present disclosure includes a tray body 1 and a wiring body 2.

Specifically, as shown in FIG. 1, the water receiving tray 10 may be provided at an indoor side of the window air conditioner 1000. The tray body 1 has a water tank 11 for receiving condensate water from an indoor heat exchanger 200 to prevent the condensate water from dripping into the window air conditioner 1000, so as to ensure the operational reliability of various components in the window air conditioner 1000, thereby ensuring the operational reliability of the window air conditioner 1000. The wiring body 2 is disposed at a side of the tray body 1 proximal to an outdoor part 202 of the window air conditioner 1000, and the wiring body 2 is provided with a wiring groove 21. An electric control box for the window air conditioner 1000 is provided at the outdoor part of the window air conditioner 1000. Connection wires for the indoor part such as a display panel may be arranged in the wiring groove 21 and connected to the electric control box of the outdoor part. Connection wires between a compressor of the outdoor part and the electric control box may also be arranged in the wiring groove 21. Meanwhile, a power cord of the window air conditioner 1000 may also be arranged in the wiring groove 21 and connected to the electric control box. As a result, the wiring inside the window air conditioner 1000 may be neater, and separate wiring structures may be avoided inside the window air conditioner 1000, which may simplify the structure and assembling process of the window air conditioner 1000, and improve the production efficiency.

For the water receiving tray 10 of the window air conditioner 1000 according to the embodiment of the present disclosure, with the wiring body 2 provided at the side of the tray body 1 proximal to the outdoor part 202 of the window air conditioner and the wiring body 2 including the wiring groove 21, the wires inside the window air conditioner 1000 may be arranged in the wiring groove 21, such that the wiring inside the window air conditioner 1000 may become neater, and separate wiring structures may be avoided inside the window air conditioner 1000, which may simplify the structure and assembling process of the window air conditioner 1000, and improve the production efficiency.

In some embodiments of the present disclosure, the wiring body 2 and the tray body 1 are detachably connected, so that the wiring body 2 and the tray body 1 may be processed separately, simplifying the processing procedure, and improving the production efficiency. The wiring body 2 and the tray body 1 may be connected by snap connection, or connected by fasteners, or connected by fasteners and the snap connection.

Certainly, the present disclosure is not limited thereto. As shown in FIG. 1, the wiring body 2 and the tray body 1 are integrally formed. Thus, the assembling process of the wiring body 2 and the tray body 1 may be simplified, and the production efficiency may be improved.

Figure 2:
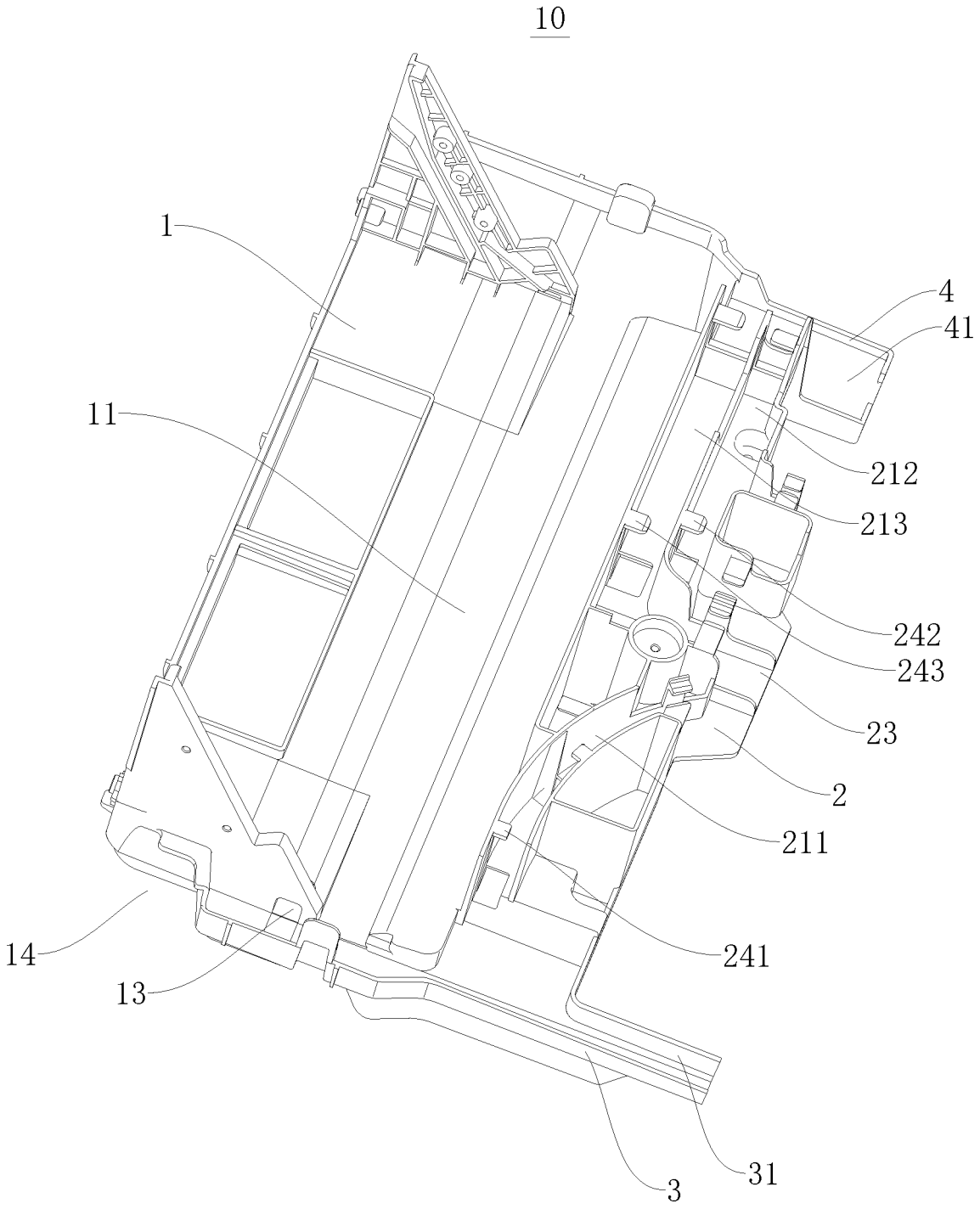
FIG. 2 is another perspective view of a water receiving tray for a window air conditioner according to an embodiment of the present disclosure.

In some embodiments of the present disclosure, as shown in FIGS. 1 and 2, the wiring groove 21 includes a power cord groove 211, a high-voltage wire groove 212, and a low-voltage wire groove 213. The power cord groove 211 is disposed at one side of the wiring body 2, while the high-voltage wire groove 212 and the low-voltage wire groove 213 are disposed at the other side of the wiring body 2. The wiring body 2 has a wire outlet 23 at an end of the wiring body distal from the tray body 1. The power cord groove 211, the high-voltage wire groove 212, and the low-voltage wire groove 213 are all in communication with the wire outlet 23. As a result, the arrangement of the power cord groove 211, the high-voltage wire groove 212, and the low-voltage wire groove 213 may be more reasonable, and the cooperation with other components inside the window air conditioner 1000 also becomes more reasonable, so that the internal structure of the window air conditioner 1000 is more compact, which is beneficial to reducing the volume of the window air conditioner 1000.

Further, as shown in FIGS. 1 and 2, the high-voltage wire groove 212 and the low-voltage wire groove 213 are spaced apart from each other in a direction from the wiring body 2 to the tray body 1. As a result, the arrangement of the high-voltage wire groove 212 and the low-voltage wire groove 213 may be more reasonable, and the cooperation with other components inside the window air conditioner 1000 also becomes more reasonable, such that the internal structure of the window air conditioner 1000 is more compact, which is beneficial to reducing the volume of the window air conditioner 1000.

In some embodiments of the present disclosure, as shown in FIGS. 1 and 2, the power cord groove 211 extends along an arc line. Because the power cord is relatively thick and difficult to be bent directly, the use of the power cord groove 211 extending along the arc line may make a bending angle of the power cord larger, which is beneficial to the change of an extension direction of the power cord. Certainly, the power cord groove 211 may also extend along a straight line, and arc-shaped transitions are adopted at both ends of a side wall of the power cord groove 211.

Further, as shown in FIGS. 1 and 2, the power cord groove 211 is an arc-shaped groove that protrudes toward the tray body 1. One end of the power cord groove 211 is in communication with the wire outlet 23, and the other end of the power cord groove 211 is located at an end of the wiring body 2 in a length direction.

In some embodiments of the present disclosure, as shown in FIGS. 1 and 2, the high-voltage wire groove 212 and the low-voltage wire groove 213 extend along straight lines and extend in a direction perpendicular to the direction from the wiring body 2 to the tray body 1; respective ends, proximal to the wire outlet 23, of side walls of the high-voltage wire groove 212 and the low-voltage wire groove 213 distal from the tray body 1 are curved surfaces. Therefore, it is convenient for wires in the high-voltage wire groove 212 and the low-voltage wire groove 213 to be bent to the wire outlet 23, so as to be connected to the electric control box, thereby preventing sharp corners at the bends from damaging the wires.

In some embodiments of the present disclosure, as shown in FIGS. 1 and 2, a water leakage hole 22 is provided at a bottom wall of the wiring groove 21. Therefore, the water in the wiring groove 21 may flow down to a chassis 20 through the water leakage hole 22, to avoid water accumulation in the wiring groove 21 and reduce potential safety hazards. Specifically, in an example shown in FIG. 1, the wiring groove 21 includes the power cord groove 211, the high-voltage wire groove 212, and the low-voltage wire groove 213. The power cord groove 211 is disposed adjacent to one end of the wiring body 2 in the length direction, while the high-voltage wire groove 212 and the low-voltage wire groove 213 are disposed adjacent to the other end of the wiring body 2 in the length direction. The high-voltage wire groove 212 and the low-voltage wire groove 213 are spaced apart from each other in a width direction of the wiring body 2. The end of the wiring body 2 distal from the tray body 1 has the wire outlet 23, and the power cord groove 211, the high-voltage wire groove 212, and the low-voltage wire groove 213 are all in communication with the wire outlet 23. Each of the power cord groove 211, the high-voltage wire groove 212, and the low-voltage wire groove 213 is provided with the water leakage hole 22, and water in the power cord groove 211, the high-voltage wire groove 212, and the low-voltage wire groove 213 may flow to the chassis 20 through the corresponding water leakage hole 22, thereby avoiding the water accumulation in the power cord groove 211, the high-voltage wire groove 212, and the low-voltage wire groove 213 and reducing the potential safety hazards.

In some embodiments of the present disclosure, as shown in FIGS. 1 and 2, one of side walls of the wiring groove 21 is provided with a retaining rib 24, and the retaining rib 24 is spaced apart from the other side wall of the wiring groove 21 and spaced apart from the bottom wall of the wiring groove 21. The wires in the wiring groove 21 may be caught between the retaining rib 24 and the bottom wall of the wiring groove 21 to prevent the wires from coming out of the wiring groove 21.

Further, a plurality of retaining ribs 24 are provided and arranged at intervals along the length direction of the wiring groove 21, and two adjacent retaining ribs 24 among the plurality of retaining ribs 24 are located at two opposite side walls of the wiring groove 21, respectively.

Specifically, as shown in FIGS. 1 and 2, a side wall of the power cord groove 211 is provided with a first retaining rib 241. The first retaining rib 241 is provided to one of side walls of the power cord groove 211. The first retaining rib 241 is spaced apart from the other side wall of the power cord groove 211 and apart from a bottom wall of the power cord groove 211. A plurality of first retaining ribs 241 are provided and arranged at intervals along a length direction of the power cord groove 211, and two adjacent first retaining ribs 241 of the plurality of first retaining ribs 241 are located at two opposite side walls of the power cord groove 211, respectively.

As shown in FIGS. 1 and 2, a side wall of the high-voltage wire groove 212 is provided with a second retaining rib 242. The second retaining rib 242 is provided to one of side walls of the high-voltage wire groove 212. The second retaining rib 242 is spaced apart from the other side wall of the high-voltage wire groove 212 and apart from a bottom wall of the high-voltage wire groove 212. A plurality of second retaining ribs 242 are provided and arranged at intervals along a length direction of the high-voltage wire groove 212, and two adjacent second retaining ribs 242 of the plurality of second retaining ribs 242 are located at two opposite side walls of the high-voltage wire groove 212, respectively.

As shown in FIGS. 1 and 2, a third retaining rib 243 is provided at a side wall of the low-voltage wire groove 213. The third retaining rib 243 is provided to one of side walls of the low-voltage wire groove 213. The third retaining rib 243 is spaced apart from the other side wall of the wire groove 213 and apart from a bottom wall of the low-voltage wire groove 213. A plurality of third retaining ribs 243 are provided and arranged at intervals along a length direction of the low-voltage wire groove 213, and two adjacent third retaining ribs 243 of the plurality of third retaining ribs 243 are located at two opposite side walls of the low-voltage wire groove 213, respectively.

In some embodiments of the present disclosure, as shown in FIGS. 1 to 5-7, a bottom wall of the water tank 11 includes a first wall surface 111 and a second wall surface 112. The first wall surface 111 is located at a side of the second wall surface 112 proximal to the wiring body 2. In a direction from the first wall surface 111 to the second wall surface 112, the first wall surface 111 is inclined downward, and the second wall surface 112 is inclined upward. Thus, condensate water on the first wall surface 111 and the second wall surface 112 may flow toward a junction of the first wall surface 111 and the second wall surface 112, so that the condensate water is collected here, which facilitates the discharge of the condensate water.

Further, as shown in FIGS. 1 and 2, a side of the tray body 1 proximal to the wiring body 2 is provided with a fluid guiding member 3 and a fluid collecting member 4. The fluid guiding member 3 and the fluid collecting member 4 have a fluid guiding groove 31 and a water collecting groove 41 respectively in communication with the water thank 11. The fluid guiding groove 31 and the water collecting groove 41 both extend along a width direction of the tray body 1 and are located at both ends of the tray body 1 in a length direction. The wiring body 2 is located between the fluid guiding groove 31 and the water collecting groove 41. The condensate water in the water tank 11 can flow toward the fluid guiding groove 31 and the water collecting groove 41 to be discharged out of the water receiving tray 10.

Furthermore, as shown in FIGS. 1 and 2, an end of the power cord groove 211 distal from the wire outlet 23 is in communication with the fluid guiding groove 31, and the water in the power cord groove 211 can flow into the fluid guiding groove 31, to avoid water accumulation in the power cord groove 211. Respective ends of the high-voltage wire groove 212 and the low-voltage wire groove 213 distal from the wire outlet 23 are in communication with the water collecting groove 41, and the water in the high-voltage wire groove 212 and the low-voltage wire groove 213 can flow toward the water collecting groove 41, to avoid water accumulation in the high-voltage wire groove 212 and the low-voltage wire groove 213 and reduce the potential safety hazards.

Figure 4:
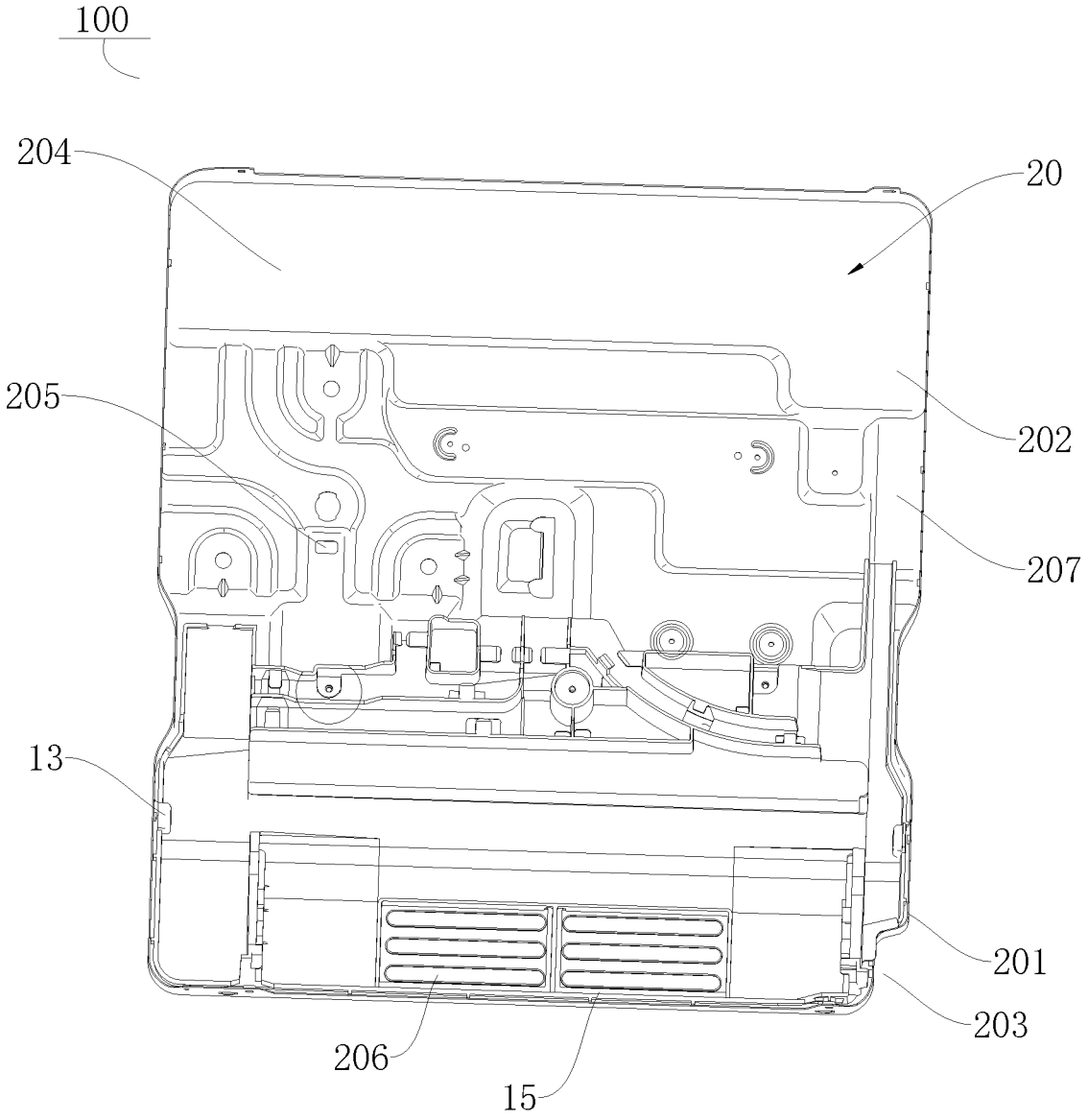
FIG. 4 is a perspective view of a chassis assembly for a window air conditioner according to an embodiment of the present disclosure.
Figure 5:
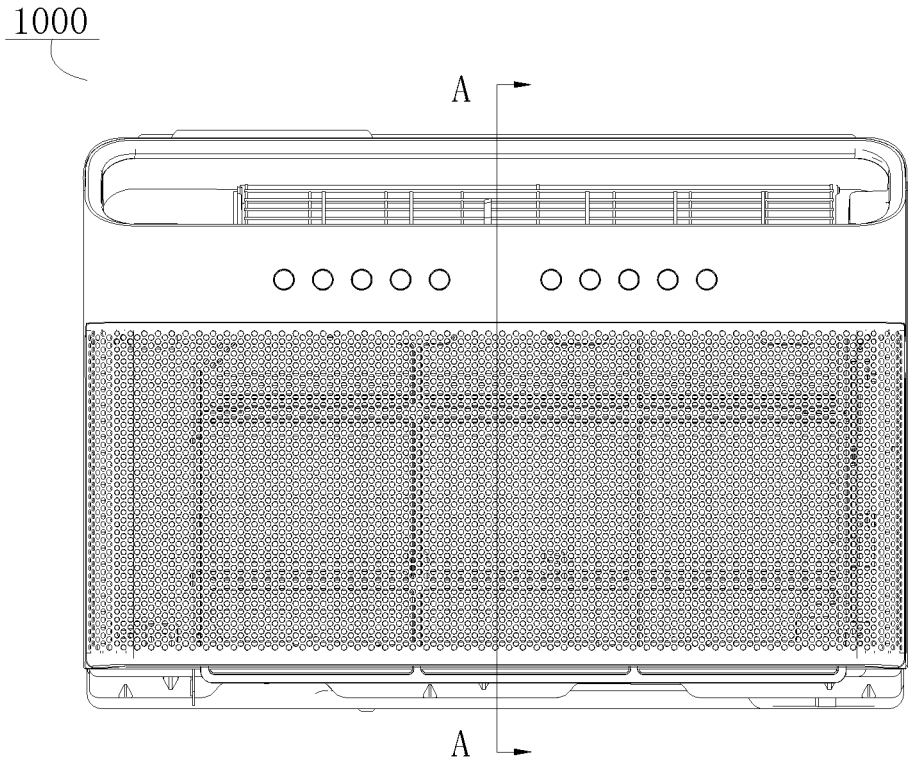
FIG. 5 is a front view of a window air conditioner according to an embodiment of the present disclosure.
Figure 6:
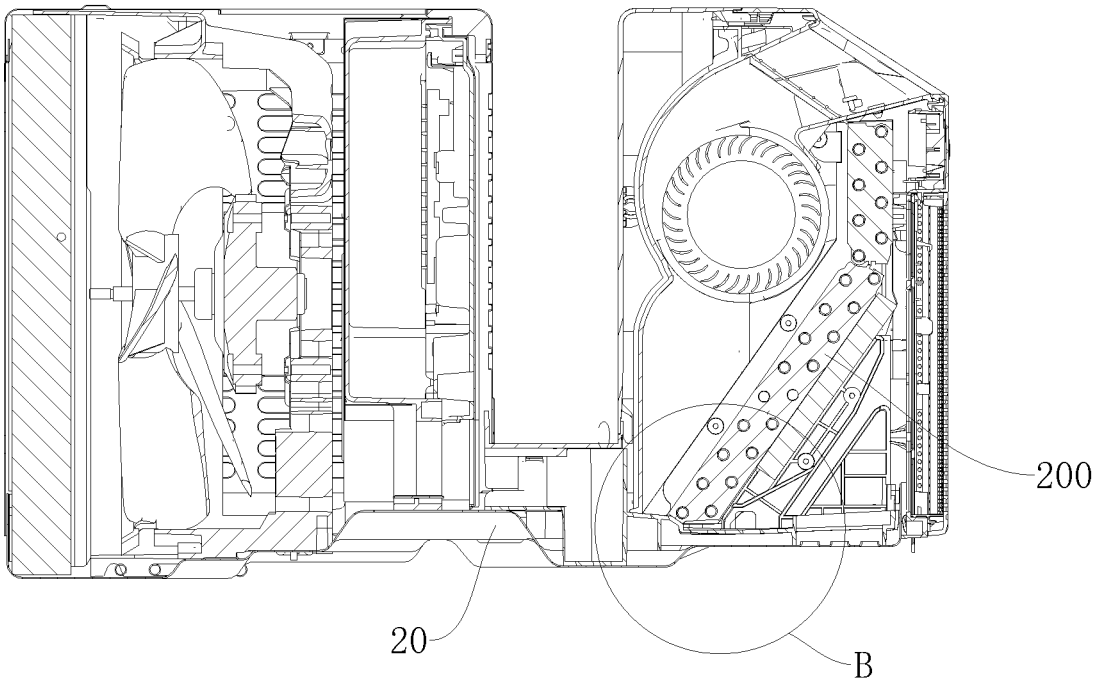
FIG. 6 is a sectional view taken along line A-A in FIG. 5.
Figure 7:
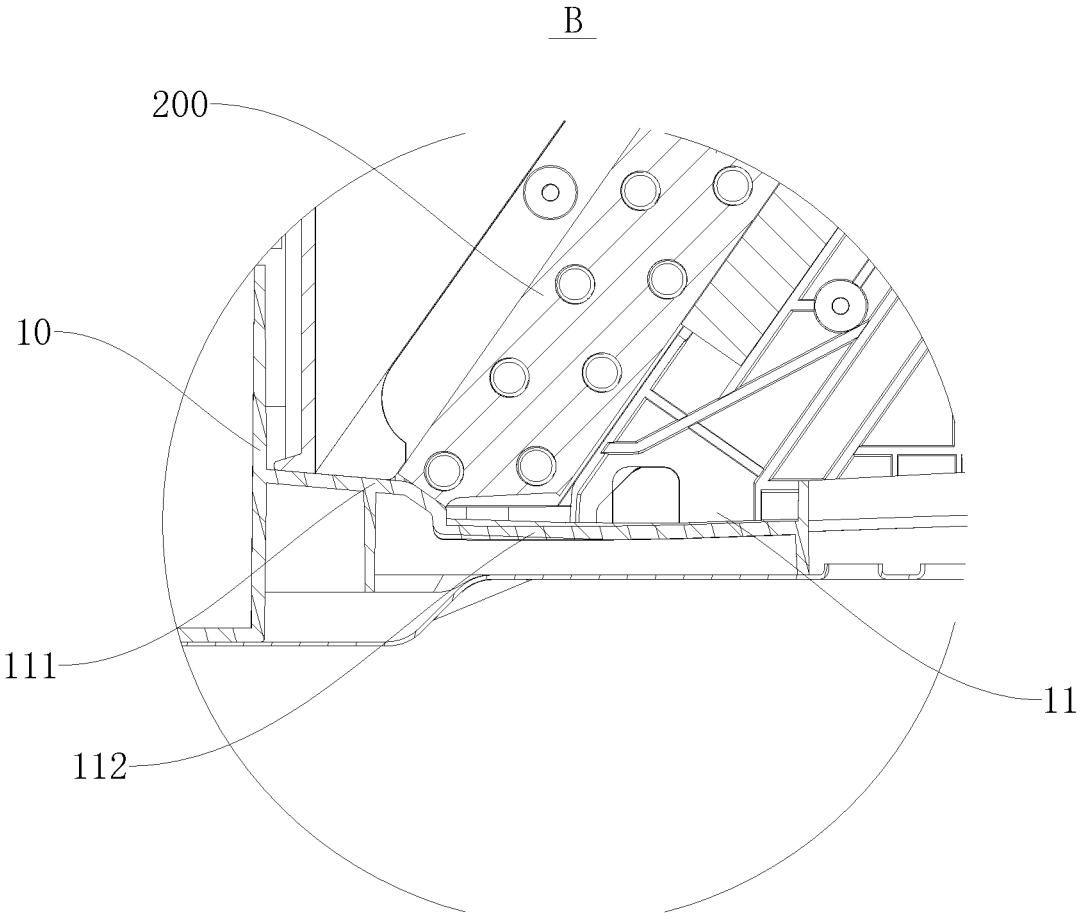
FIG. 7 is an enlarged view of part B in FIG. 6.

In some embodiments of the present disclosure, as shown in FIGS. 1 and 2, the first wall surface 111 is inclined downward in a direction from the water collecting groove 41 to the fluid guiding groove 31. Therefore, the condensate water on the first wall surface 111 can flow to the fluid guiding groove 31, so that most of the condensate water in the water receiving tray 10 flows out from the fluid guiding groove 31, and a small part thereof flows out from the water collecting groove 41. As shown in FIG. 4, the chassis 20 includes an indoor part 201 and an outdoor part 202. The tray body 1 is located at the indoor part 201. The outdoor part 202 has a mounting groove 204 for mounting a supercooling tube, and the fluid guiding groove 31 is in communication with the mounting groove 204. Therefore, most of the condensate water in the water tank 11 can flow into the mounting groove 204 to supercool the supercooling tube. The outdoor part 202 has a drain hole 205, and the water collecting groove 41 is in communication with the drain hole 205. The condensate water flowing out through the water collecting groove 41 may be discharged through the drain hole 205 of the chassis 20.

Figure 3:
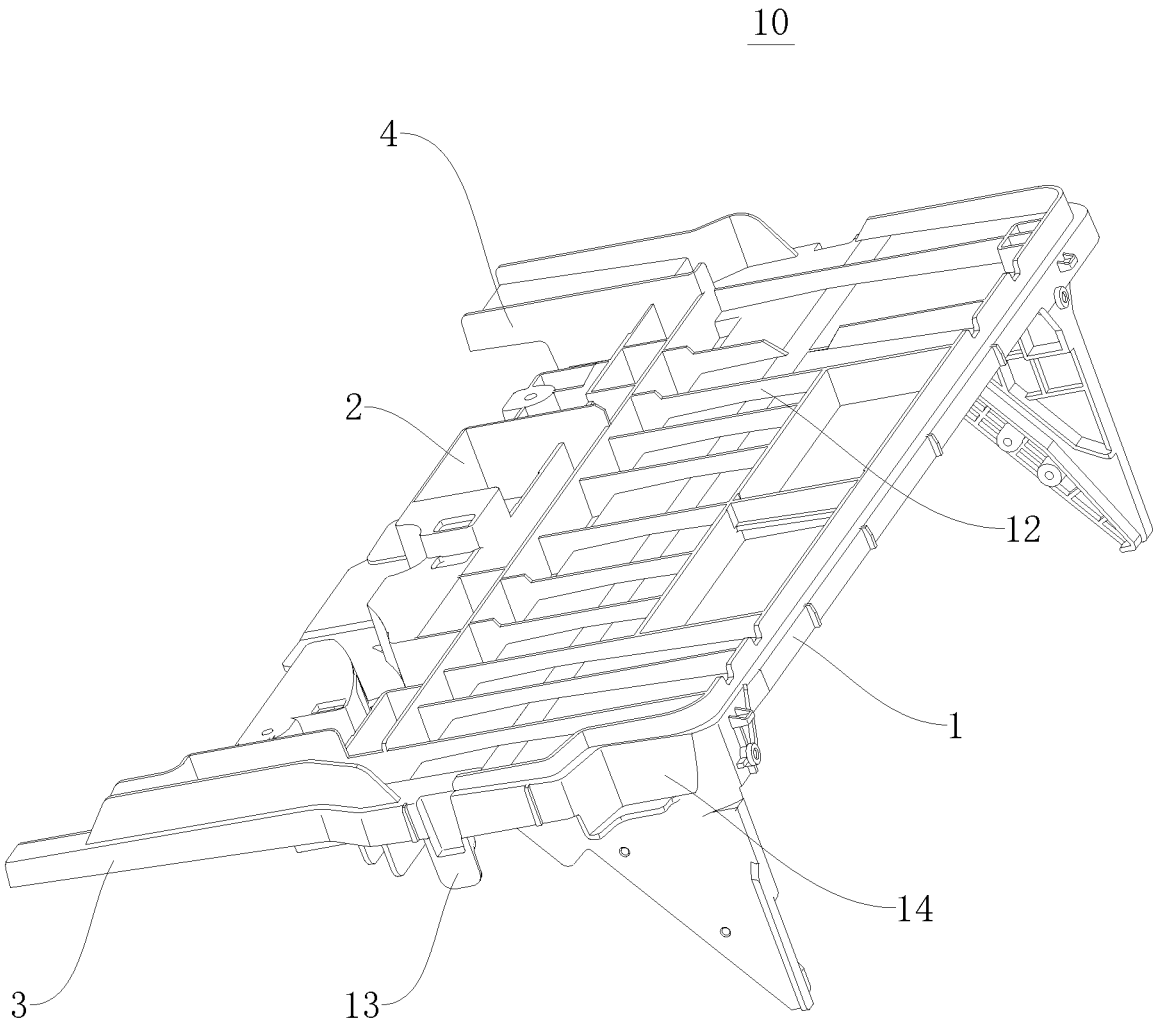
FIG. 3 is still another perspective view of a water receiving tray for a window air conditioner according to an embodiment of the present disclosure.

In some embodiments of the present disclosure, as shown in FIG. 3, a reinforcement rib 12 is provided under the tray body 1. On the one hand, the reinforcement rib 12 may enhance the structural strength of the water receiving tray 10; on the other hand, the reinforcement rib 12 may separate a bottom wall of the tray body 1 from an inner bottom wall of the chassis 20, to avoid condensate water from being easily generated between the plastic water receiving tray 10 and the metal chassis 20.

Further, a plurality of reinforcement ribs 12 are provided and arranged at intervals. Thus, the structural strength of the water receiving tray 10 may be further reinforced, and at the same time, the possibility of producing the condensate water between the water receiving tray 10 and the chassis 20 is further reduced. For example, in the example shown in FIG. 1, the bottom wall of the tray body 1 is provided with a plurality of reinforcement ribs 12, each reinforcement rib 12 extends along the width direction of the tray body 1, and the plurality of reinforcement ribs 12 are arranged at intervals along the length direction of the tray body 1.

A chassis assembly 100 for the window air conditioner 1000 according to embodiments of the present disclosure will be described below with reference to the drawings.

As shown in FIG. 4, the chassis assembly 100 according to an embodiment of the present disclosure includes the chassis 20 and the water receiving tray 10 of the window air conditioner 1000 described above.

As shown in FIG. 4, the chassis 20 includes the indoor part 201 and the outdoor part 202. The tray body 1 is located at the indoor part 201. The water tank 11 may be used to receive the condensate water of the indoor heat exchanger 200, prevent the condensate water of the indoor heat exchanger 200 from dripping into the window air conditioner 1000, and ensure the operational reliability of various components in the window air conditioner 1000, thereby ensuring the operational reliability of the window air conditioner 1000.

For the chassis assembly 100 of the window air conditioner 1000 according to the present disclosure, with the wiring body 2 provided at the side of the tray body 1 proximal to the outdoor part 202 of the window air conditioner and the wiring body 2 including the wiring groove 21, the wires inside the window air conditioner 1000 may be arranged in the wiring groove 21, such that the wiring inside the window air conditioner 1000 may become neater, and separate wiring structures may be avoided inside the window air conditioner 1000, which may simplify the structure and assembling process of the window air conditioner 1000, and improve the production efficiency.

In some embodiments of the present disclosure, as shown in FIGS. 1 and 2, the water receiving tray 10 and the chassis 20 are connected by fasteners and/or through snap connection. It could be understood that the water receiving tray 10 and the chassis 20 may be connected only by fasteners, or the water receiving tray 10 and the chassis 20 may be connected only through the snap connection, or the water receiving tray 10 and the chassis 20 may be connected by fasteners and the snap connection at the same time. Thus, the connection reliability of the water receiving tray 10 and the chassis 20 may be improved, and the connection method between the water receiving tray 10 and the chassis 20 may be simplified.

For example, in an example shown in FIG. 4, the wiring body 2 and the chassis 20 are connected by two fasteners. A side wall of the tray body 1 distal from the wiring body 2 is connected to a side wall of the chassis 20 by fasteners and through the snap connection. Specifically, the side wall of the tray body 1 distal from the wiring body 2 is provided with two first connection holes for fasteners to pass through and provided with two first snaps. The two first snaps are in one-to-one correspondence to the two first connection holes and located under the corresponding first connection holes. The side wall of the chassis 20 is provided with second connection holes for the fasteners to pass through and provided with second snaps fitted with the first snaps.

In some embodiments of the present disclosure, as shown in FIGS. 1 and 4, a wire clasp 13 is provided at an end of the tray body 1, and the wire clasp 13 is spaced apart from the side wall of the chassis 20 to form a wiring space. The wires may pass between the wire clasp 13 and the side wall of the chassis 20, and the storage of the wires inside the window air conditioner 1000 may be facilitated.

Further, as shown in FIG. 1, the wiring groove 21 includes the power cord groove 211. The power cord groove 211 is provided at one side of the wiring body 2, and the wire clasp 13 is located at the end of the tray body 1 proximal to the power cord groove 211. The power cord may be snapped into the wiring space formed between the wire clasp 13 and the side wall of the chassis 20, which facilitates the storage of the power cord.

Furthermore, as shown in FIGS. 2 to 4, an end of an outer peripheral wall of the tray body 1 distal from the outdoor part 202 and proximal to the wire clasp 13 is provided with a first notch 14 through which the power cord passes. An outer peripheral wall of the chassis 20 is provided with a second notch 203 through which the power cord passes. The second notch 203 is corresponding to the first notch 14. In this way, the power cord may pass through the first notch 14 and the second notch 203 and go out of the window air conditioner 1000, to be connected to an external power source, and the coming out of the power cord is facilitated.

In some embodiments of the present disclosure, as shown in FIGS. 1 and 4, the outdoor part 202 has the mounting groove 204 for mounting the supercooling tube. The side of the tray body 1 proximal to the wiring body 2 is provided with the fluid guiding member 3, and the fluid guiding member 3 has the fluid guiding groove 31 in communication with the water thank 11. The fluid guiding groove 31 is located at one end of the tray body 1 in the length direction. An end of the fluid guiding groove 31 extends toward the mounting groove 204 and is in communication with the mounting groove 204. Thus, the condensate water in the water tank 11 may flow to the fluid guiding groove 31, and then flow to the mounting groove 204 to supercool the supercooling tube in the mounting groove 204, which improves the energy efficiency of the window air conditioner 1000 and may also solve the discharge problem of the condensate water.

Further, as shown in FIG. 4, the outdoor part 202 is provided with a guide groove 207. An end of the fluid guiding groove 31 distal from the tray body 1 is in communication with one end of the guide groove 207, and the other end of the guide groove 207 is in communication with the mounting groove 204. Therefore, the length of the fluid guiding member 3 may be reduced, and the structure and processing technique of the water receiving tray 10 may be simplified.

Further, as shown in FIGS. 1 and 4, the outdoor part 202 has the drain hole 205. The side of the tray body 1 proximal to the wiring body 2 is provided with the fluid collecting member 4, and the fluid collecting member 4 has the water collecting groove 41 in communication with the water thank 11. The water collecting groove 41 is located at the other end of the tray body 1 in the length direction. An end of the water collecting groove 41 extends toward the outdoor part 202 and is in communication with the drain hole 205. Thus, part of the condensate water in the water tank 11 may flow to the water collecting groove 41, and then flow to the drain hole 205 to be discharged out of the window air conditioner 1000.

In addition, the water collecting groove 41 may also receive condensate water dripping from a refrigerant tube at an end of the indoor heat exchanger 200.

In some embodiments of the present disclosure, as shown in FIGS. 1 and 4, a bottom wall of the indoor part 201 is provided with an air inlet hole 206, and the tray body 1 is provided with an avoidance hole 15 corresponding to the air inlet hole 206. In this way, the air intake into the indoor may be increased, and the wind output may be increased to meet users' requirements.

A window air conditioner 1000 according to embodiments of the present disclosure will be described below.

The window air conditioner 1000 according to the present disclosure includes the chassis assembly 100 described above.

For the window air conditioner 1000 according to the present disclosure, with the wiring body 2 provided at the side of the tray body 1 proximal to the outdoor part 202 of the window air conditioner and the wiring body 2 including the wiring groove 21, the wires inside the window air conditioner 1000 may be arranged in the wiring groove 21, such that the wiring inside the window air conditioner 1000 may become neater, and separate wiring structures may be avoided inside the window air conditioner 1000, which may simplify the structure and assembling process of the window air conditioner 1000, and improve the production efficiency.

In some embodiments of the present disclosure, the bottom wall of the water tank 11 includes the first wall surface 111 and the second wall surface 112. The first wall surface 111 is located at the side of the second wall surface 112 proximal to the wiring body 2. In the direction from the first wall surface 111 to the second wall surface 112, and the first wall surface 111 is inclined downward, the second wall surface 112 is inclined upward. A lower end of the indoor heat exchanger 200 of the window air conditioner 1000 abuts against the first wall surface 111. The lower end of the indoor heat exchanger 200 abuts on an inclined surface of the first wall surface 111, which may achieve sealed connection between the indoor heat exchanger 200 and the water receiving tray 10, prevent the airflow entering the indoor part 201 from flowing away between the indoor heat exchanger 200 and the water receiving tray 10, and avoid a problem of air leakage.

In the description of the present specification, reference throughout this specification to "an embodiment," "some embodiments," "an exemplary embodiment," "an example," "a specific example" or "some examples" means that a particular feature, structure, material, or characteristic described in connection with the embodiment or example is included in at least one embodiment or example of the present disclosure. Thus, the appearances of the above phrases throughout this specification are not necessarily referring to the same embodiment or example of the present disclosure. Furthermore, the particular features, structures, materials, or characteristics may be combined in any suitable manner in one or more embodiments or examples.

Although embodiments of the present disclosure have been shown and described, it would be appreciated by those skilled in the art that changes, modifications, alternatives and variations may be made in the embodiments without departing from the scope of the present disclosure. The scope of the invention is defined by the claims and the like.

What is claimed is:

1. A water receiving tray for a window air conditioner comprising:

a tray body including a water tank; and a wiring body provided at a side of the tray body proximal to an outdoor part of the window air conditioner, the wiring body including a wiring groove;

wherein:

the tray body includes a fluid guiding member and a fluid collecting member at a side of the tray body proximal to the wiring body, the fluid guiding member and the fluid collecting member including a fluid guiding groove and a water collecting groove, respectively, in communication with the water tank;

the wiring body is located between the fluid guiding groove and the water collecting groove;

a bottom wall of the water tank includes a first wall surface and a second wall surface, the first wall surface is located at a side of the second wall surface proximal to the wiring body, and in a first direction from the first wall surface to the second wall surface, the first wall surface inclines downward and the second wall surface inclines upward; and the first wall surface inclines downward in a second direction from the water collecting groove to the fluid guiding groove, the first direction being perpendicular to the second direction.

2. The water receiving tray according to claim 1, wherein:

the wiring groove includes:

a power cord groove disposed at one side of the wiring body;

a first wire groove and a second wire groove disposed at another side of the wiring body;

the wiring body further includes a wire outlet at an end of the wiring body distal from the tray body; and the power cord groove, the first wire groove, and the second wire groove are in communication with the wire outlet.

3. The water receiving tray according to claim 2, wherein the first wire groove and the second wire groove are spaced apart from each other in a direction from the wiring body to the tray body.

4. The water receiving tray according to claim 2, wherein the power cord groove extends in an arched shape.

5. The water receiving tray according to claim 2, wherein:

the first wire groove and the second wire groove extend along straight lines in a direction perpendicular to a direction from the wiring body to the tray body;

each of the first wire groove and the second wire groove has a distal side wall distal from the tray body, and an end of each of the distal side walls that is proximal to the wire outlet includes a curved surface.

6. The water receiving tray according to claim 1, further comprising:

a water leakage hole provided at a bottom wall of the wiring groove.

7. The water receiving tray according to claim 1, further comprising:

a reinforcement rib provided under the tray body.

8. The water receiving tray according to claim 1, wherein:

both the fluid guiding member and the fluid collecting member extend from the water tank in the first direction away from the water tank;

along the second direction, the fluid guiding groove and the water collecting groove sandwich the wiring body.

9. A chassis assembly for a window air conditioner comprising:

a chassis including an indoor part and an outdoor part; and a water receiving tray including:

a tray body including a water tank and located at the indoor part; and a wiring body provided at a side of the tray body proximal to an outdoor part of the window air conditioner, the wiring body including a wiring groove;

wherein:

the tray body includes a fluid guiding member and a fluid collecting member at a side of the tray body proximal to the wiring body, the fluid guiding member and the fluid collecting member including a fluid guiding groove and a water collecting groove, respectively, in communication with the water tank;

the wiring body is located between the fluid guiding groove and the water collecting groove;

a bottom wall of the water tank includes a first wall surface and a second wall surface, the first wall surface is located at a side of the second wall surface proximal to the wiring body, and in a first direction from the first wall surface to the second wall surface, the first wall surface inclines downward and the second wall surface inclines upward; and the first wall surface inclines downward in a second direction from the water collecting groove to the fluid guiding groove, the first direction being perpendicular to the second direction.

10. The chassis assembly according to claim 9, wherein the tray body includes a wire clasp provided at an end of the tray body and spaced apart from a side wall of the chassis.

11. The chassis assembly according to claim 10, wherein:

the wiring groove includes a power cord groove provided at a side of the wiring body; and the wire clasp is located at an end of the tray body proximal to the power cord groove.

12. The chassis assembly according to claim 11, wherein:

the tray body includes a first notch at an end of an outer peripheral wall of the tray body distal from the outdoor part and proximal to the wire clasp; and the chassis includes a second notch at an outer peripheral wall of the chassis, the second notch corresponding to the first notch.

13. The chassis assembly according to claim 9, wherein:

the outdoor part of the chassis includes a mounting groove; and the tray body includes a fluid guiding member at a side of the tray body proximal to the wiring body, the fluid guiding member including a fluid guiding groove in communication with the water tank and located at one end of the tray body, and an end of the fluid guiding groove extending toward the mounting groove and being in communication with the mounting groove.

14. The chassis assembly according to claim 13, wherein:

the outdoor part of the chassis includes a guide groove;

an end of the fluid guiding groove distal from the tray body is in communication with one end of the guide groove; and another end of the guide groove is in communication with the mounting groove.

15. The chassis assembly according to claim 13, wherein:

the outdoor part of the chassis includes a drain hole; and the tray body further includes a fluid collecting member at the side of the tray body proximal to the wiring body, the fluid collecting member including a water collecting groove in communication with the water tank and located at another end of the tray body, and an end of the water collecting groove extending toward the outdoor part of the chassis and being in communication with the drain hole.

16. The chassis assembly according to claim 9, wherein:

the indoor part of the chassis includes an air inlet hole at a bottom wall of the indoor part; and the tray body includes an avoidance hole corresponding to the air inlet hole.

17. A window air conditioner comprising:

the chassis assembly of claim 9; and an indoor heat exchanger located at the indoor part, the water tank being configured to receive condensed water from the indoor heat exchanger.

18. A water receiving tray for a window air conditioner comprising:

a tray body including:

a water tank;

a fluid guiding member; and a fluid collecting member; and a wiring body provided at a side of the tray body proximal to an outdoor part of the window air conditioner, the wiring body including a wiring groove;

wherein:

the fluid guiding member and the fluid collecting member include a fluid guiding groove and a water collecting groove, respectively, in communication with the water tank;

both the fluid guiding member and the fluid collecting member extend from the water tank in a first direction away from the water tank;

along a second direction from the water collecting groove to the fluid guiding groove, the fluid guiding groove and the water collecting groove sandwich the wiring body; and at least a part of a bottom wall of the water tank inclines downward in the second direction, the first direction being perpendicular to the second direction.

* * * * *